United States Patent [19]

Pflüger

[11] Patent Number: 4,995,599

[45] Date of Patent: Feb. 26, 1991

[54] MACHINIST'S VISE WITH ADJUSTABLE PRESSURE LIMITER

[75] Inventor: Ludwig Pflüger, Bitburg/Moetsch, Fed. Rep. of Germany

[73] Assignee: Carl Ullrich Peddinghaus, Wuppertal-Barmen, Fed. Rep. of Germany

[21] Appl. No.: 496,983

[22] Filed: Mar. 20, 1990

Related U.S. Application Data

[63] Continuation-in-part of Ser. No. 247,109, Sep. 20, 1988, Pat. No. 4,940,216.

[30] Foreign Application Priority Data

Sep. 30, 1987 [DE] Fed. Rep. of Germany ..... 3732900
Mar. 24, 1989 [DE] Fed. Rep. of Germany ..... 3909812

[51] Int. Cl.[5] ..... B23Q 3/08

[52] U.S. Cl. ..... 269/32; 269/24; 269/27; 269/207

[58] Field of Search ..... 269/24, 25, 27, 32, 269/63, 67, 69, 207; 74/71, 74, 105; 192/93 C, 93 R, 95

[56] References Cited

U.S. PATENT DOCUMENTS

| | | | |
|---|---|---|---|
| 2,472,783 | 6/1949 | Barrere | 192/93 |
| 3,147,002 | 9/1964 | Arnold | 269/24 |
| 3,630,512 | 12/1971 | Paret | 269/207 |
| 3,767,183 | 10/1973 | Van Gelder | 269/207 |

FOREIGN PATENT DOCUMENTS 2051119 1/1979 Fed. Rep. of Germany .

2710424 5/1987 Fed. Rep. of Germany .

*Primary Examiner*—J. J. Hartman

*Attorney, Agent, or Firm*—Herbert Dubno; Andrew Wilford

[57] ABSTRACT

A vise has a stationary jaw, a movable jaw, an outer hollow high-speed spindle threaded in the fixed jaw and formed with a radially open entrainment recess, and an inner low-speed spindle threaded in the outer spindle. A hand crank is rotationally fixed on an inner spindle and an entrainment pin is displaceable transversely in the inner spindle between an entrainment position engaged in the recess and rotationally coupling the inner spindle to an outer spindle and a freeing position clear of the recess and permitting relative rotation of the spindles. A switching piece on the inner spindle can operate a bolt to press the operating bolt into the camming surface in a low-speed position of the switching piece and thereby pull the entrainment pin out of the recess to decouple the spindles and in a high-speed position frees the operating bolt from the camming surface and couples the spindles to each other. A stop collar rotatable and axially displaceable on the outer spindle has a front face engageable directly with the movable jaw and a back face formed with a plurality of pairs of diametrally opposite notches of different depths. The switching piece is selectively engageable in the pairs of notches so that the collar limits displacement of the switching piece axially forward toward the movable jaw by distances depending on which pair of notches the switching piece is engaged in and the distances correspond to respective clamping forces.

4 Claims, 5 Drawing Sheets

MACHINIST'S VISE WITH ADJUSTABLE PRESSURE LIMITER

CROSS-REFERENCE TO RELATED APPLICATION

This application is a continuation-in-part of my copending patent application No. 07/247,109 filed 20 Sept. 1988, now U.S. Pat. No. 4,490,216.

FIELD OF THE INVENTION

The present invention relates to a clamping device. More particularly this invention concerns a two-range machinist's vise.

BACKGROUND OF THE INVENTION

In my above-cited copending patent application I describe a vise having a stationary jaw, a movable jaw displaceable longitudinally toward and away from the stationary jaw, an outer hollow high-speed spindle threaded in a nut on the fixed jaw and formed with a radially open entrainment recess, and an inner low-speed spindle threaded in the outer spindle. A piston-and-cylinder unit on the movable jaw has primary and secondary pistons respectively engaged by the outer and inner spindles. A hand crank is rotationally fixed on the inner spindle and an entrainment pin is displaceable transversely in the inner spindle between an entrainment position engaged in the recess and rotationally coupling the inner and outer spindles to each other and a freeing position clear of the recess and permitting relative rotation of the inner and outer spindles. This entrainment pin is formed with a longitudinally directed camming surface. A switching piece displaceable on the inner spindle between a high-speed position and a low-speed position can operate a bolt displaceable along the inner spindle and engageable with the entrainment pin and with the switching piece for pressing the operating bolt into the camming surface in the low-speed position of the switching piece and thereby pull the entrainment pin out of the recess to decouple the spindles and in the high-speed position frees the operating bolt from the camming surface and couples the spindles to each other.

The main problem with such a clamping device is that it is capable of exerting so much pressure on the workpiece in the low-speed position that it can crush the workpiece. The high mechanical advantage in the low-speed high-force position gives no feedback to the user to let him or her know that too much force is being exerted. Although it is possible to determine how much pressure is exerted by gauging how far in the inner spindle has gone, this is not a usable method in practice.

In German patent document No. 2,710,624 a device for limiting pressure comprises a rim formed on the actuating spindle that is engaged by a sleeve on the high-speed spindle. The sleeve is formed internally with grooves of various lengths into which a bolt carried on the actuating spindle can engage. The different-length grooves limit the stroke of the actuating spindle and thereby also set a limit to the pressure that can be exerted. This arrangement is not readily adaptable the system of the parent application. Since the spindle is provided with a transverse switching piece there are problems in making the adaptation. The result would be an excessively long high-speed spindle set up to make the stop sleeve accessible.

SUMMARY OF THE INVENTION

These objects are obtained in a vise of the above-described type that is provided with a stop collar rotatable and axially displaceable on the outer spindle and having a front face engageable directly with the movable jaw and a back face formed with a plurality of pairs of diametrally opposite notches of different depths and complementary to the switching piece. The switching piece is selectively engageable in the pairs of notches so that the collar limits displacement of the switching piece axially forward toward the movable jaw by distances depending on which pair of notches the switching piece is engaged in and the distances correspond to respective clamping forces.

With this arrangement before the vise is operated the appropriate set of notches is aligned with and fitted over the switching piece. Then the vise is cranked until the collar bottoms, at which point the predetermined force will have been exerted on the workpiece, no more, no less. The switching piece, which is axially nondisplaceable in the spindle, therefore serves as an abutment also.

In accordance with further features of this invention the collar is releasably retained on the spindle in positions with the notches aligned with and fitting over the switching piece. To this end a pair of diametrally opposite spring-loaded elements are provided in the collar that can engage in respective seats on the spindle. Thus the collar is held in which ever position it is set in, even when the piece is fitted to a pair of very shallow notches. The seats can be provided only for the shallow notch pair, or more preferably for each notch pair.

In addition according to this invention the collar is provided with indicia corresponding to the respective clamping forces. Thus the user need merely read off and then set the desired clamping force, which can be calibrated in Newtons.

With the system of this invention it is possible to accurately determine the maximum clamping force that the vise will exert. This eliminates the possibility of damaging a fragile workpiece. The improvement of the invention adds insignificantly to the cost of producing the vise and in now way makes the vise longer or more unwieldy than that of the parent application.

DESCRIPTION OF THE DRAWING

The above and other objects, features, and advantages will become more readily apparent from the following, reference being made to the accompanying drawing in which.

SPECIFIC DESCRIPTION

Figure 1:
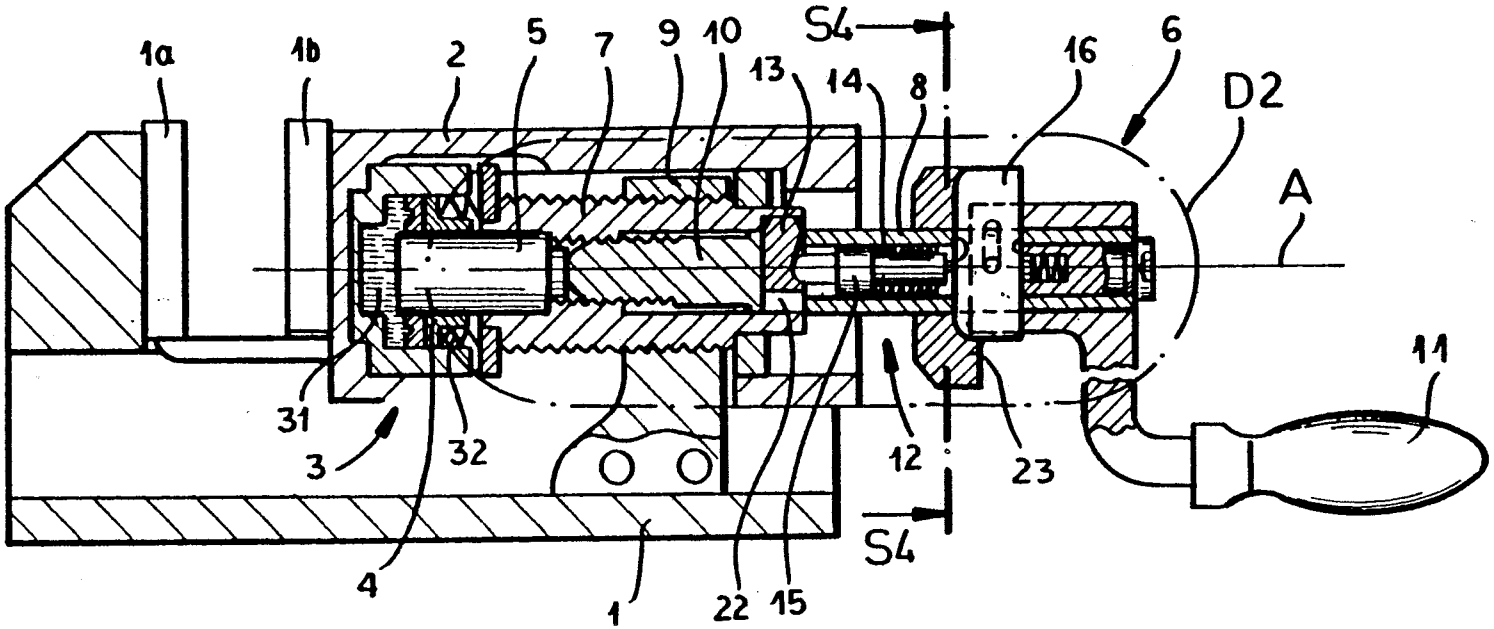
FIG. 1 is a vertical axial section through the vise according to this invention.

As seen in FIG. 1 a machinists' vise according to the invention has a body 1 carrying a rearwardly facing fixed jaw plate 1*a*, a movable jaw 2 having a forwardly directed face plate 2*a* confronting the jaw plate 1*a*, a clamping piston-cylinder unit 3 with an outer piston 4 and a coaxial inner piston 5 as well as a hand crank drive 6. The drive 6 includes a hollow high-speed outer spindle 7 and a partially hollow low-speed inner spindle 8. The clamping piston-cylinder unit 3 is mounted within the movable clamping jaw 2 and, more specifically, is at least partially surrounded by the hollow high-speed spindle 7. This unit 3 has a liquid-filled chamber 31 defined on one side by the back face of the movable jaw 2 and on the other side by the front face of the inner piston 5 and by the annular piston 4 surrounding the piston 5 and braced by a stack of spring washers 32 against the front face of the spindle 7. The spindle 7 is threaded in a spindle nut 9 attached to the stationary body 1.

A hand crank 11 which is part of the drive 6 is fixed to the low-speed operating spindle 8 and is rotatable therewith about an axis A thereof. The spindle 8 is formed with a diametrally throughgoing rectangular-section slot 22 in which is slidable a complementarily shaped transverse entraining pin 13. The front (left hand in FIG. 1) end of the inner spindle 8 forms a push rod 10 that itself is threaded inside the outer spindle 7 and that is braced axially against the inner piston 5.

Figure 2:
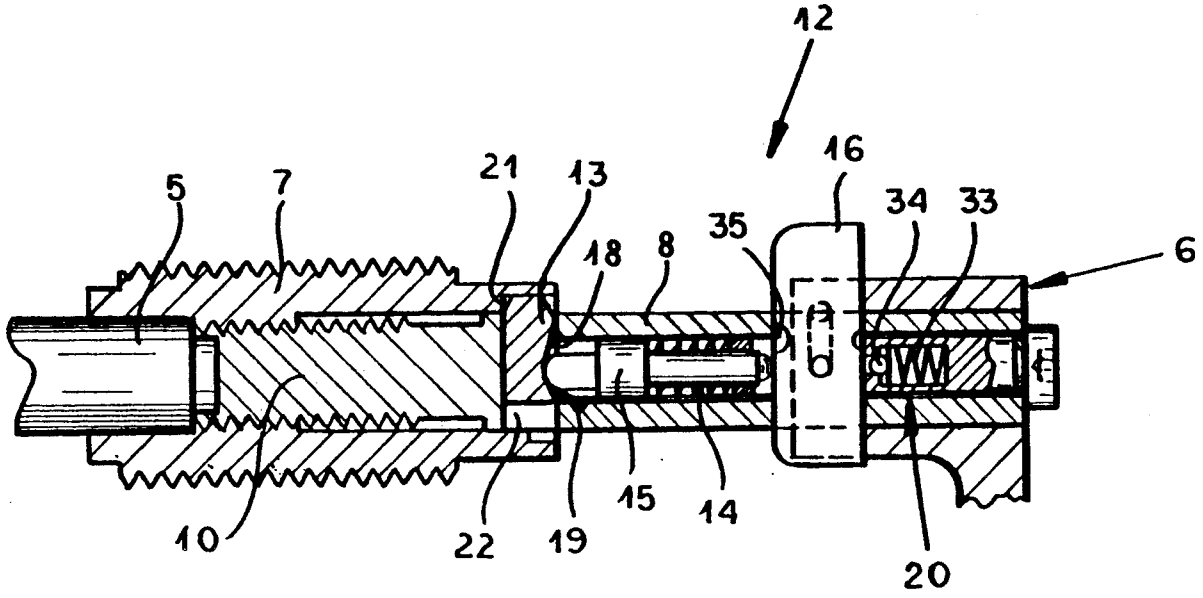
FIG. 2 is a large-scale view of the detail indicated at D2 in FIG. 1, with the vise in the high-speed low-force mode.

A clutch or coupling mechanism 12 is provided within the hollow operating spindle 8 for switching the entraining pin 13 into a high-speed low-force position illustrated in FIG. 2 in which it engages in a radially inwardly open notch 17 in the high-speed spindle 7 and thereby couples the spindles 7 and 8 together for joint rotation and joint axial movement of the pistons 4 and 5. The outer spindle 7 bears via the springs 32 on the back face of the jaw 2 so same will be pressed forward with a force directly proportional to the torque applied to the crank 11 multiplied by a factor determined by the pitch of the screwthread between the spindle 7.

Figure 3:
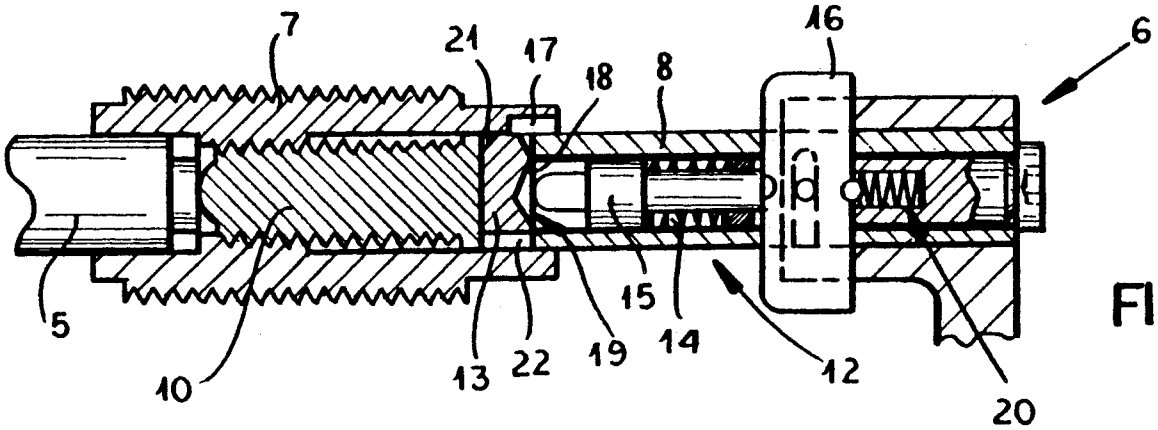
FIG. 3 is a view like FIG. 2 with the vise in the low-speed high-force mode.
Figure 4:
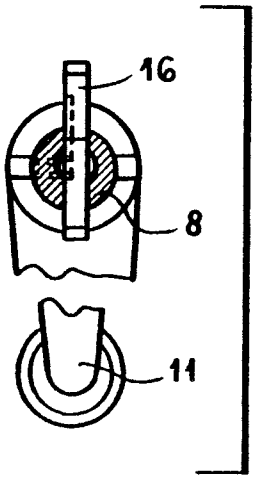
FIG. 4 is a section taken along section line S4—S4 of FIG. 1.
Figure 5:
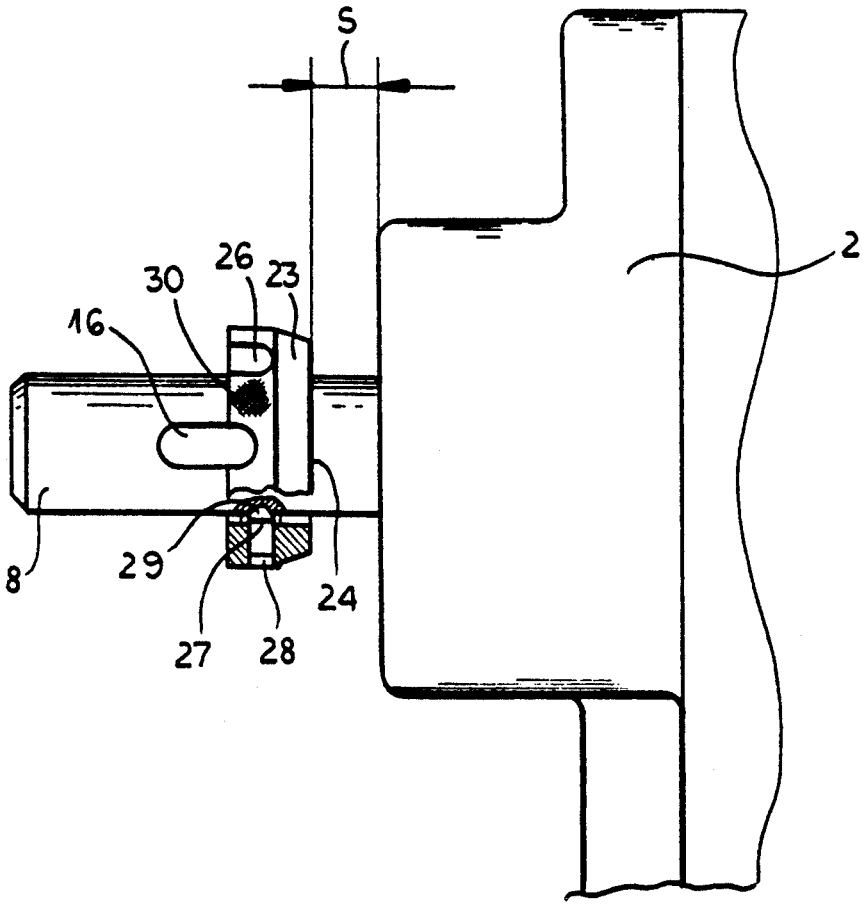
FIG. 5 is a large-scale top view of the right-hand end of the vise as seen in FIG. 1, but with the operating handle removed for clarity of view.
Figure 6:
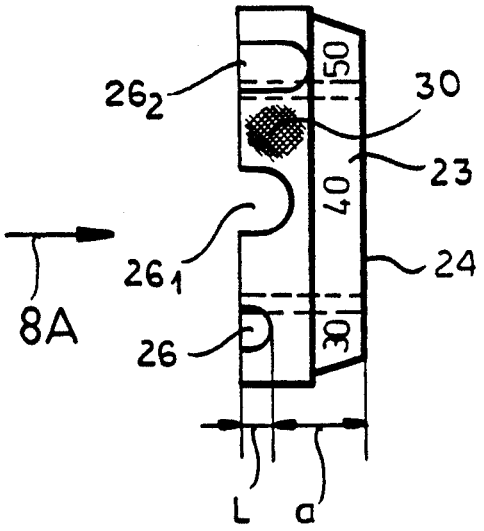
FIG. 6 is a larger-scale detail view of the force-limiting collar of the vise.
Figure 7:
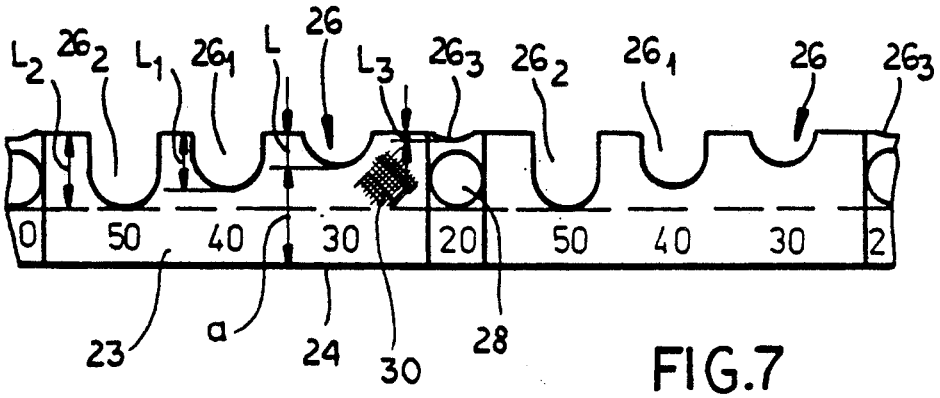
FIG. 7 is a developed view of the outer surface of the collar.
Figure 8:
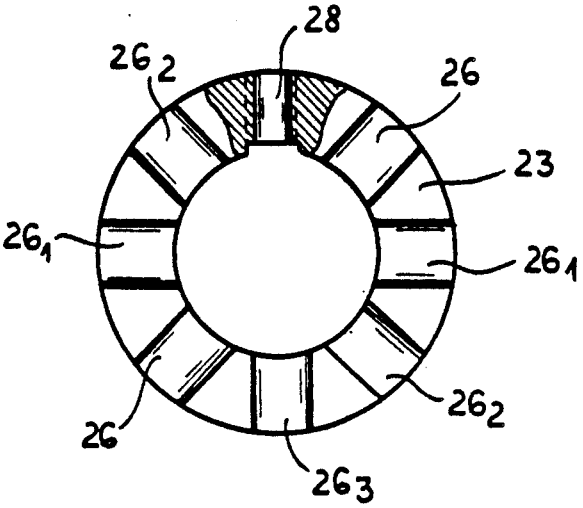
FIG. 8 is a partly sectional end view taken in the direction of arrow 8A of FIG. 6.

FIG. 3 illustrates a low-speed high-force position of the clutch 12 wherein the pin 13 is clear of the coupling notch 17 and out of coupling engagement with the outer spindle 7 so that the inner spindle 8 and its piston 10 can be screwed in the outer spindle 7 and thereby push forward the piston 5. This will move the jaw 2 forward on the spindle 7 with a force that is much greater than will be exerted in the FIG. 2 position since the piston 5, which is of small effective surface area, will pressurize the chamber 31 in which the jaw 2 has a much larger effective surface area.

A comparison of FIGS. 2 and 3 shows that the clutch 12 comprises the transverse entraining pin 13, a positioning bolt 15 biased against the pin 13 by a return spring 14 and a transversely shifting switch piece 16. Mounted within the operating spindle 8 is a major portion of the shifting piece 16. The transverse entraining pin 13 can be forced radially outward into the entraining pin recess 17 by forcing the positioning bolt 15 axially forward into an axially rearwardly open positioning cavity 19 formed in the pin 13 and itself formed with a camming surface 18.

The positioning bolt 15 can be forced into the positioning cavity 19 by the switching piece 16 which in turn has an engaged and a disengaged position which are seen respectively in FIGS. 2 and 3. Engagement and disengagement may readily be achieved by manually pressing the shifting piece 16 upward or downward. A hollow slot within the shifting piece 16 accommodates a portion of the clutch 12 thereby permitting engagement and disengagement. The transversely shifting piece 16 is retained in the engaged and disengaged positions by a locking mechanism 20 including a spring 33 that is compressed when the clutch 12 is disengaged from the shifting piece 16. Upward movement of the shifting piece 16 to allow engagement of clutch 12 causes expansion of the spring 33 of the locking mechanism 20, which spring presses a ball 34 against the piece 16. A slot within the shifting piece 16 accepts a portion of the expanded spring for such latching.

A bevelled camming surface 21 is formed on the outer end of the transverse entraining pin 13. When the transversely shifting piece 16 is moved to the disengaged position and the operating spindle 8 is rotated by the hand crank 11, the bolt 15 of the clutch 12 is urged away from the positioning surface 18 against the force of its spring 14 by camming engagement of the surface 21 with the edge of the notch 17. Then the transverse entraining pin 13 is no longer prevented from being cammed downward by the operating spindle 8 through pressure by the bevelled surface 21. FIG. 3 shows the position in which the transverse entraining pin 13 has been moved from the entraining pin recess 17 in this way.

According to this invention an annular stop collar 23 shown in detail in FIGS. 5 through 8 is fitted to the spindle 8. This collar 23 has a front face 24 lying in a plane perpendicular to the axis A and flatly engageable with the rear face of the movable jaw 2 and a rear face formed with four pairs of seats or notches 26, $26_1$, $26_2$, and $26_3$ of different respective depths L, $L_1$, $L_2$, and $L_3$ shaped complementarily to receive the front edge of the switch piece 16. The collar 23 can rotate about the axis A on the spindle 8 and is retained in any of four angularly equi-spaced and offset positions thereon by a pair of diametrally opposite spring-loaded retaining element 27 received in respective bores 28 formed in the collar 23 and engaged in respective retaining seats 29 formed in the spindle 8. The surface of the collar 23 is milled as indicated at 30 to make it easy to manipulate.

The force of the spring 14 is such that with the cross piece 16 in the FIG. 3 position with its notch 35 aligned with the bolt 15, this bolt 15 will be pushed back by camming action at the surface 21 when rotation of the spindle 7 is resisted with a relatively small force. This will effect automatic switchover from high-speed low-force movement of the jaw 2 to low-speed high-force movement. The switchover point will always be the same and will always occur at a predetermined axial position of the spindle 8, namely the position of FIG. 2.

Starting at this switchover point the face 24 of the collar 23 is spaced by a distance s from the back face of the jaw 2, this distance s being a function of which set of notches 26–26, $26_3$ the crosspiece 16 is seated in, which in turn is a function of how much of the collar projects a distance a forward past the crosspiece 16. The distances a for the pairs of notches are 5.4 mm, 7.8 mm, 10 mm, and 13 mm. Since a predetermined pressure is always being exerted at the start of the low-speed high-force mode of operation, the axial stroke of the piston 5 is directly proportional to the pressure the jaw 2 will exert toward the jaw plate 1*a*. When the spindle 8 is rotated enough by the crank 11 to bottom the face 24 against the jaw 2, the respective pressures exerted will be 20 kN, 30 kN, 40 kN, and 50 kN.

I claim:

1. A vise comprising:

a stationary jaw;

a movable jaw displaceable axially toward and away from the stationary jaw;

a nut fixed on the stationary jaw;

an outer hollow high-speed spindle threaded in the nut and formed with a radially open entrainment recess;

an inner low-speed spindle threaded in the outer spindle;

a piston-and-cylinder unit on the movable jaw having primary and secondary pistons respectively engaged by the outer and inner spindles;

a hand crank rotationally fixed on the inner spindle;

an entrainment pin displaceable transversely in the inner spindle between an entrainment position engaged in the recess and rotationally coupling the inner and outer spindles to each other and a freeing position clear of the recess and permitting relative rotation of the inner and outer spindles, the entrainment pin being formed with a axially directed camming surface;

a switching piece displaceable on the inner spindle between a high-speed position and a low-speed position;

means including an operating bolt displaceable along the inner spindle and engageable with the entrainment pin and with the switching piece for pressing the operating bolt into the camming surface in the low-speed position of the switching piece and thereby pulling the entrainment pin out of the recess to decouple the spindles and for freeing the operating bolt from the camming surface and coupling the spindles to each other in the high-speed position of the switching piece; and a stop collar rotatable and axially displaceable on the outer spindle and having a front face engageable directly with the movable jaw and a back face formed with a plurality of pairs of diametrally opposite notches of different depths and complementary to the switching piece, and means for fixing said stop collar relative to said outer spindle, whereby the switching piece is engagable with a selected pair of notches, and whereby the collar limits displacement of the switching piece axially forward toward the movable jaw by different distances depending on which pair of notches the switching piece is engaged in and whereby the different distances correspond to different respective clamping forces.

2. The vise defined in claim 1, further comprising means for releasably retaining the collar on the spindle in positions with the notches aligned with and fitting over the switching piece.

3. The vise defined in claim 2 wherein the retaining means includes a pair of diametrally opposite spring-loaded elements in the collar and respective seats on the spindle.

4. The vise defined in claim 1 wherein the collar is provided with indicia corresponding to the respective clamping forces.

* * * * *